United States Patent [19]

Poweleit et al.

[11] Patent Number: 4,896,021

[45] Date of Patent: Jan. 23, 1990

[54] PORTABLE ELECTRIC HAIR DRYER

[75] Inventors: Hans-Dieter Poweleit, Haan; Heinrich Komesker, Wuppertal, both of Fed. Rep. of Germany

[73] Assignee: Robert Krups Stiftung & Co. KG, Solingen, Fed. Rep. of Germany

[21] Appl. No.: 234,795

[22] Filed: Aug. 22, 1988

[30] Foreign Application Priority Data

Sep. 5, 1987 [DE] Fed. Rep. of Germany ..... 3729774

[51] Int. Cl.[4] ..... H05B 1/02

[52] U.S. Cl. ..... 219/370; 34/97; 219/373

[58] Field of Search ..... 219/366–370, 219/371–374; 34/96, 98, 121, 97

[56] References Cited

U.S. PATENT DOCUMENTS

| | | | |
|---|---|---|---|
| 1,816,055 | 7/1931 | Pfeifer | 219/371 |
| 3,383,779 | 5/1968 | Trouilhet | 219/370 X |
| 3,857,016 | 12/1974 | Meyer et al. | 219/370 X |
| 4,260,875 | 4/1981 | Walter et al. | 219/370 X |
| 4,711,988 | 12/1987 | Thaler et al. | 219/370 X |
| 4,767,914 | 8/1988 | Glucksman | 219/370 |

*Primary Examiner*—William M. Shoop, Jr.
*Assistant Examiner*—A. Jonathan Wysocki
*Attorney, Agent, or Firm*—Peter K. Kontler

[57] ABSTRACT

A portable electric hair dryer wherein the housing contains an electric motor for an impeller which induces the flow of air from an inlet of the housing, along an electric heater in the housing and to and through an outlet of the housing. The casing of the motor is surrounded by a ring-shaped diffuser with stationary guide vanes which uniformize the flow of air toward the heater. The controls of the motor are mounted on a circuit board which carries one or more triacs, diodes and/or other electronic components which are heated when connected with a source of electrical energy and must be cooled when the hair dryer is in use. The heatable electronic component or components are mounted on an extension of the circuit board, and such extension is installed directly in the diffuser between two neighboring guide vanes. To this end, one of the guide vanes is removed or omitted and the electronic component or components take the place of the missing guide vane.

13 Claims, 2 Drawing Sheets

PORTABLE ELECTRIC HAIR DRYER

BACKGROUND OF THE INVENTION

The invention relates to electric appliances in general, and more particularly to improvements in appliances of the type wherein an electric motor is employed to drive one or more impellers which convey one or more flows of air through the housing of the appliance. Examples of such electric appliances are portable hair dryers, space heaters and fans. The invention will be described primarily with reference to portable electric hair dryers; however, it is to be understood that such hair dryers constitute but one type of electric appliances which can embody the present invention.

A portable electric hair dryer normally comprises an elongated housing of insulating material which is provided with a grip type handle and has an air inlet at one end and an outlet for heated air at the other end. The means for drawing air into the housing by way of the inlet is a rotary impeller which is driven by an electric motor and induces a flow of air toward the outlet whereby the air stream passes along one or more electric heating elements. The outlet can be provided with a detachable air flow concentrating nozzle. It is further known to provide the hair dryer with a diffuser (also called guide wheel) which is affixed to the casing in the region of the motor and serves to guide the flow of air into the range of the heating element or elements. The diffuser has an annulus of equidistant guide vanes or blades and can be installed between the impeller and the electric heater. The motor is connectable with a suitable energy source by way of an electric cable and a switch which is mounted in or on the handle. The motor also comprises a control unit, normally a printed circuit board with several electrical and/or electronic components, such as one or more diodes and/or a so-called triac (this is a bidirectional triode thyristor, namely a gate-controlled semiconductor switch which can be used with advantage for alternating-current power control). A drawback of such components is that they are heated in response to connection with a source of electrical energy so that they must be cooled when the hair dryer is in use.

One presently known proposal to cool the thyristor or thyristors on the printed circuit board of an electric motor in a portable electric hair dryer includes confinement of the thyristor or thyristors in a hollow cylinder one end portion of which partially surrounds the electric motor and the periphery of which supports the carrier or carriers of electric heating elements. Such proposal has failed to gain acceptance in the industry because the cylinder is nearly closed so that the rate of air circulation therein is nil or negligible and, therefore, the thyristor or thyristors are not subjected to any appreciable cooling action.

Another presently known proposal includes mounting the thyristor or thyristors between the electric heater and the internal surface of the housing of a portable electric hair dryer. This contributes to a more satisfactory cooling action; however, the thyristor or thyristor are still likely to be overheated.

OBJECTS OF THE INVENTION

An object of the invention is to provide an electric appliance wherein a motor drives one or more impellers to induce the flow of air through the housing of the appliance and wherein the component or components which are heated when the appliance is in use are less likely to be overheated than in heretofore known appliances.

Another object of the invention is to provide the appliance with novel and improved means for cooling one or more thyristors, diodes and like electronic components on the circuit board of the motor in a portable electric hair dryer or another electric appliance which is equipped with means for inducing the flow of air through its housing.

A further object of the invention is to provide a novel and improved motor for use in the above outlined appliance.

An additional object of the invention is to provide a novel and improved guide wheel for use in a portable electric hair dryer or an analogous appliance.

Still another object of the invention is to provide a portable electric hair dryer wherein one or more diodes, thyristors or like components of the motor circuit are cooled in a novel and improved way.

A further object of the invention is to provide an electric appliance wherein the component or components which are likely to be overheated in the absence of any undertakings to the contrary can be cooled in a simple, efficient and inexpensive manner without necessitating an increase in the bulk, weight and/or cost of the appliance.

Another object of the invention is to provide a novel and improved method of heating the bidirectional triode thyristor in the motor circuit of a portable electric hair dryer.

SUMMARY OF THE INVENTION

The invention is embodied in an electric appliance, such as a portable hair dryer, which comprises a hollow housing having an air-admitting inlet and an air discharging outlet, an electric motor which is installed in the housing and has at least one component (such as a triac, a diode or another electronic component) which is heated when connected with a source of electrical energy, impeller means connected with the motor and serving to induce the flow of air through the housing from the inlet to the outlet, and diffuser means provided in the housing in the path of the flow of air from the inlet to the outlet. In accordance with a feature of the invention, the at least one component is disposed in the housing in the region of the diffuser means. If the improved appliance is a portable electric hair dryer, the housing further contains electric heater means which is installed in the housing between the diffuser means and the outlet to heat air which is induced to flow toward and to issue from the outlet.

In accordance with another feature of the invention, the diffuser means comprises a plurality of guide vanes or blades and the at least one component is installed directly in the diffuser means between two of the guide vanes. Such guide vanes preferably form an annulus with spaces between neighboring guide vanes of the annulus. Such spaces include a relatively wide space (which can constitute a recess in the diffuser means) for the at least one component and narrower additional spaces of equal width as measured in the circumferential direction of the annulus. The width of the relatively wide space or recess in the circumferential direction of the annulus of guide vanes can equal or approximate the combined width of two additional spaces plus the thickness of a guide vane, i.e., the at least one component can replace a missing guide vane.

The motor can include a circuit board which has an extension supporting the at least one component in the recess of the diffuser means. The diffuser means has surfaces which surround the recess and include two substantially parallel surfaces and a third surface which is disposed between the parallel surfaces and has a notch for a portion (particularly for the free end) of the extension of the circuit board. Such impeller means has an additional surface which bounds a portion of the notch in the third surface and makes with a plane which is normal to the axis of rotation of the impeller means a first angle preferably matching or approximating the angle between a guide vane and such plane. Each guide vane can have an arcuate shape, and the angle which an arcuate guide vane makes with the aforementioned plane is then the angle between such plane and a straight line extending between the edges of the arcuate guide vane. Otherwise stated, the inclination of the additional surface relative to the aforementioned parallel surfaces preferably equals or approximates 90 degrees minus the angle between the aforementioned plane and a guide vane.

The novel features which are considered as characteristic of the invention are set forth in particular in the appended claims. The improved appliance itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 5:
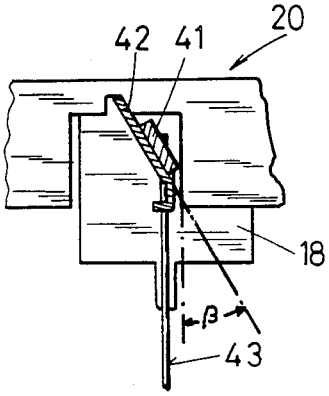
FIG. 5 shows the structure of FIG. 4 and a portion of the motor together with the circuit board an the circuit board extension which supports the electronic component.

The drawing shows only those parts of a portable electric hair dryer 10 which are necessary for complete understanding of the invention. For example, the drawing does not show all details of the electric circuit of a motor 18 for a rotary impeller 22 and/or all details of an electric heater 16. The motor circuit includes a printed circuit board 43 a portion of which is shown in FIG. 5 and which can be installed in the electric heater 16 downstream of the motor 18 (as seen in the direction of air flow from the inlet to the outlet of the housing of the hair dryer 10. The housing comprises a tubular front section 11 for the electric heater 16 and tubular a rear section 12 for the impeller 22. All such parts of the hair dryer 10 which are not shown in the drawing but are necessary for satisfactory operation of the appliance can be constructed and assembled in a conventional manner, e.g., as in the so-called "Turbo Pocket" travel hair dryer No. 415 which is manufactured and sold by the assignee of the present application. Reference may also be had to commonly owned copending patent application Ser. No. 171,480 filed Mar. 21, 1988 by Ohlsen for ÞPortable Hair Dryer" and to commonly owned copending patent application Ser. No. filed July 11, 1988 by Komesker et al. for "Electrical appliance with built-in circuit interrupter".

Figure 3:
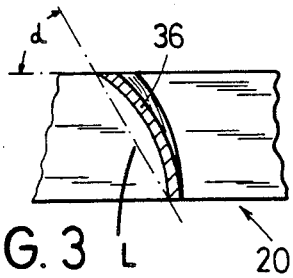
FIG. 3 is a fragmentary sectional view of the diffuser means, substantially as seen in the direction of arrows from the line III—III of FIG. 2.

The inlet of the housing including the sections 11 and 12 comprises an air filter 13 which is attached to the section 12, and the outlet comprises a one-piece grate or grid 15 which is installed in the section 11 behind a detachable air flow concentrating nozzle 14. The sections 11 and 12 of the housing are preferably made of an insulating plastic material and are permanently or separably connected to each other in a manner not forming part of the present invention. The same holds true for the manner of securing the filter 13 to the section 12 and for the manner of installing the grid 14 in the section 11. The filter 13 can be separably coupled to the open rear end of the housing section 11 by suitable detent elements. In accordance with a presently preferred embodiment, the filter 13 is formed with a number of concentric ringshaped openings each of which consists of a series of arcuate slots separated from each other by radially extending ribs. Such arrays of arcuate slots can be seen in FIG. 3 of the aforementioned copending patent application Ser. No. 171,480 of Ohlsen.

Figure 4:
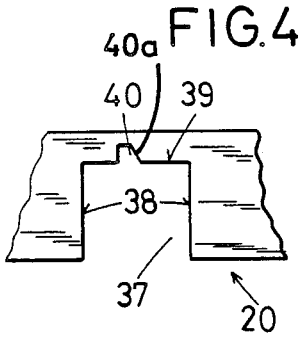
FIG. 4 is a fragmentary elevational view of the diffuser means and shows the recess for the electronic component of the motor for the impeller means.

The grid 15 constitutes a one-piece plastic insert which may be of the type shown in FIGS. 4 to 6 of the copending patent application Ser. No. 171,480 of Ohlsen. It comprises several concentric rings with radial partitions between neighboring rings. At least one of the rings forming part of the grid 15 is preferably inclined with reference to the common axis A—A of the motor 18 and impeller 22. The inclination of such ring with reference to the axis A—A can be in the range of 25°.

The internal surface of the open front end of the housing section 11 has a circumferentially extending groove 138 for elastic prongs 139 of the nozzle 14. The groove 138 is located in front of and is spaced apart from an internal shoulder 140 which is provided in the housing section 11 and serves as an abutment for the front end face of the grid 15. The prongs 139 yield radially inwardly in response to exertion of a pull upon the nozzle 14 so that the latter can be separated from the housing section 11. These prongs are held in the groove 138 by snap action. The groove 138, the prongs 139 and the internal shoulder 140 can be formed during making of the housing section 11 and nozzle 14.

The rear end face of the grid 15 constitutes a stop for the front end portions of a set of longitudinally extending carriers 17 in the form of flat panels which are installed in the housing section 11 behind the grid 15 and serve to support electric heating elements (not shown) of the heater 16. Such heating elements can include straight or helically wound wires which are secured to the respective carriers 17 and can be connected with an energy source when the motor 18 is on so as to heat air which is induced to flow from the openings of the filter 13 toward and into the nozzle 14. The front portions of the carriers 17 can actually extend into complementary sockets of the grid 15 so that they are reliably held in optimum positions within the confines of the housing section 11.

The motor 18 is spacedly surrounded by a stationary diffuser or guide wheel 20 the details of which are shown in FIGS. 2 to 5 and which has an annulus of arcuate guide vanes or blades 36 serving to guide air into the range of heating elements on the carriers 17 of the heater 16. The entire diffuser 20 can constitute a one-piece body of insulating plastic material. The illustrated diffuser 20 comprises a substantially flat central portion 33 which extends at right angles to the axis A—A and is secured to the casing of the motor 18 by several fasteners 32, e.g., three equidistant screws which surround a centrally located hub 31 forming part of the impeller 22 and being non-rotatably secured to the output shaft 21 of the motor 18. The radially outermost part of the flat portion 33 is integral with a forwardly extending tubular portion 34 which merges into a radially outwardly extending washer-like portion 19. The latter is integral with a forwardly extending tubular or cylindrical support 35 for the vanes 36 of the diffuser 20. The axes of the support 35 and tubular portion 34 can coincide with the axis A—A.

The illustrated diffuser 20 has eleven vanes 36 which define ten equal (relatively narrow spaces **36*a* and a wider space or recess 37 flanked by the two neighboring vanes 36 and having width matching the combined width of two spaces 36*a* plus the thickness of a vane 36 (as measured in the circumferential direction of the tubular support 35 and the annulus of vanes 36 thereon. The recess 37 is obtained by removing one of originally twelve equidistant vanes 36 or by forming the diffuser 20 with eleven vanes which are distributed in a manner as shown in FIG. 2**.

The inclination of a line L (FIG. 3) which connects the marginal portions of a vane 36 with reference to a plane which is normal to the axis A—A (e.g., with reference to the plane of the flat diffuser portion 33) is indicated by the angle $\alpha$. This angle is or can approximate 60°.

The recess 37 of the diffuser 20 accommodates a bidirectional triode thyristor 41 which is a heatable component of the motor circuit and is mounted on an extension 42 of a circuit board 41. The latter supports many additional components of the motor circuit, e.g., components of the type used in the aforementioned "Turbo Pocket" travel dryer No. 415 of the assignee of the present application.

Figure 2:
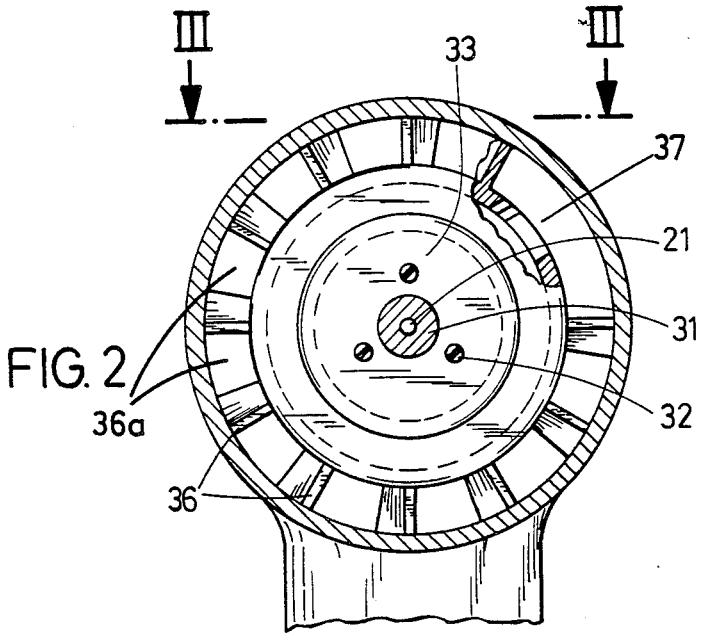
FIG. 2 a transverse sectional view of the housing in the region of the diffuser means as seen at right angles to the axis of the impeller means.

The recess 37 is located between the one and three o'clock positions of the diffuser 20, as seen in FIG. 2, and is bounded by two parallel surfaces 38 and a third surface 39 of the diffuser 20. The surface 39 extends between the surfaces 38 and is provided with a notch 40 for the free end portion of the extension 42 of the circuit board 43. A surface **40*a* in the notch 40 of the diffuser 20 is inclined in the same way as the line L, i.e., the angle $\beta$ which is shown in FIG. 5 equals $90°-\alpha$. The extension 42 is inclined with reference to the major portion of the circuit board 43. When the end portion of the extension 42 is caused to snap into the notch 40 in the surface 39 of the diffuser 20, the thyristor 41 is properly located in the interior of the diffuser and can be adequately cooled by the stream of relatively cool atmospheric air which is drawn by the blades of the impeller 22 and is in the process of flowing toward the heater 16. The tyristor 41 can be soldered to the circuit board 43 and can be said to constitute a substitute for the missing twelfth guide vane 36 of the impeller 20. Therefore, the thyristor 41 is subjected to a highly satisfactory cooling action as soon as the motor 18 is started to rotate the impeller 22 by way of the output shaft 21 and to thus induce the flow of air from the inlet (filter 13) toward the outlet (grid 15 and nozzle 14) of the housing including the sections 11 and 12**.

The carriers 17 of the electric heating elements in the heater 16 are preferably offset relative to the vanes 36 of the diffuser 20, e.g., in a manner as shown in FIG. 2 of the copending patent application Ser. No. 171,480 of Ohlsen. Such distribution of carriers 17 relative to the guide vanes 36 ensures the establishment of a turbulent flow of air in the region of the heater 16 to thus reduce the likelihood of overheating the housing section 11. This, in turn, renders it possible to make the housing section 11 of a relatively inexpensive plastic material which need not stand elevated temperatures.

The diffuser 20 constitutes a holder or support for the electric motor 18. As mentioned above, the casing of the motor 18 is affixed to the flat portion 33 of the diffuser 20 by several screws 32 or in any other suitable way. The impeller 22 is adjacent the flat portion 33 of the diffuser 20 and can extend, at least in part, into the filter 13. The exact construction of the motor 18 forms no part of the invention. The same applies for the impeller 22 and the mode of securing the hub 31 of the impeller to the output shaft 21 of the motor.

When the hair dryer 10 is in use, the circuit of the motor 18 is completed and the output element 21 drives the impeller 22 which draws air through the openings of the filter 13 so that air flows through the spaces **36*a* and the recess 37 of the diffuser 20 and cools the thyristor 43 on the extension 42 of the circuit board 43 prior to being heated in the heater 16 on its way beyond the motor 18 and into and through the grid 15 and nozzle 14. The latter can be attached to or detached from the housing section 11 while the hair dryer 10** is in actual use.

Figure 1:
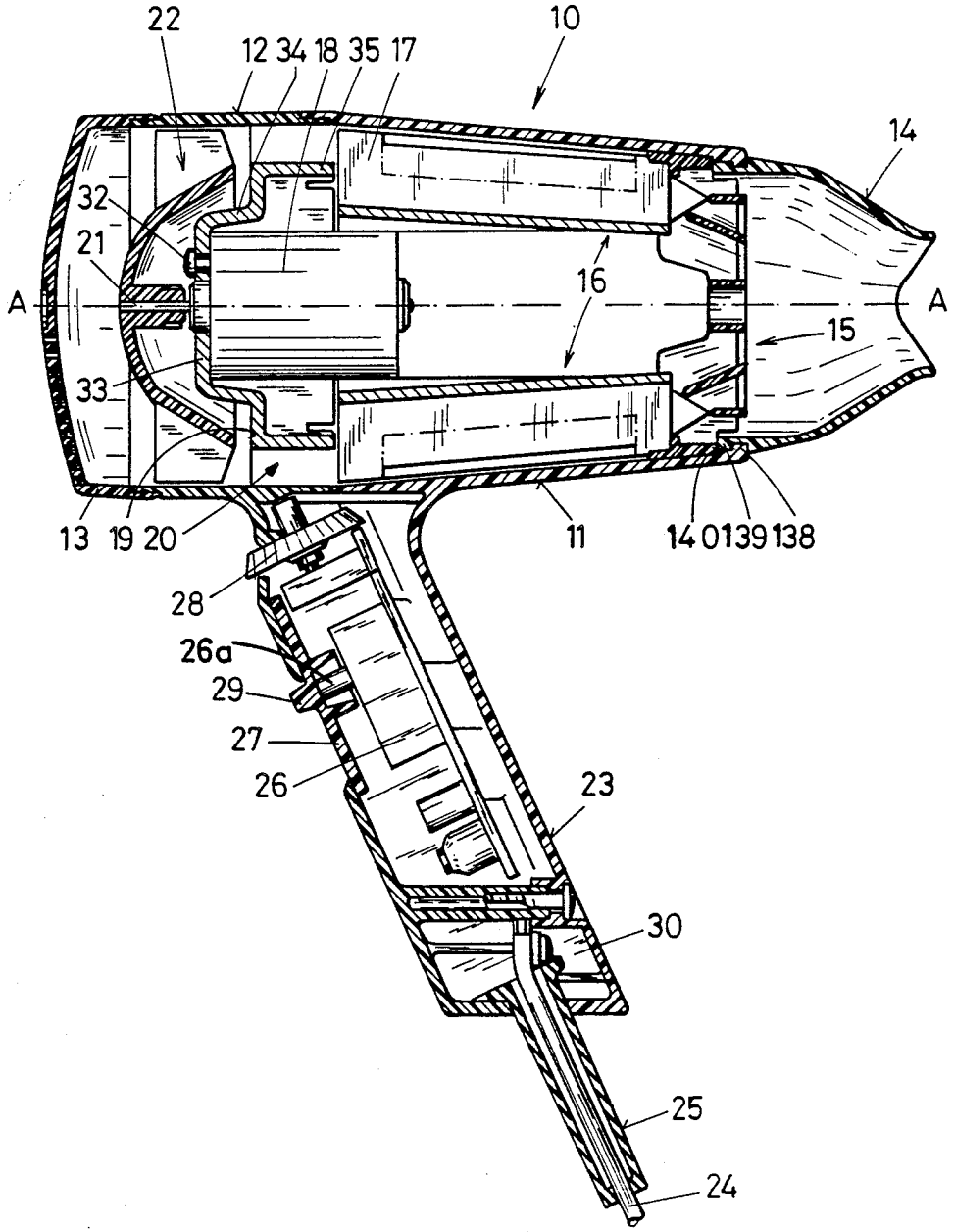
FIG. 1 is a schematic central sectional view of a portable electric hair dryer which embodies the invention and wherein the housing carries a detachable air flow concentrating nozzle.

FIG. 1 shows that the housing of the hair dryer 10 further comprises a hollow handle or grip 23 which extends downwardly and forwardly (as seen in FIG. 1) and makes with the axis A—A a relatively large acute angle. The hollow handle 23 accommodates several additional parts of the hair dryer 10. Such additional parts include an electric switch 26 whose actuator **26*a* is coupled to a slidable cover plate or shield 27. The shield 27 has a projection 29 which can be manipulated by one finger of the hand holding the handle 23 to open or close the switch 26. The terminals of the switch 26 are connected with the current-consuming components of the motor circuit and with the conductors of an electric cable 24 which extends from the bottom end portion of the handle 23 and has a free end portion provided with a plug (not shown) for insertion into a household outlet or into any other suitable source of electrical energy. A protective sheath 25 is provided to prevent excessive flexing or buckling of the cable 24 at the locus of entry into the hollow handle 23, and the latter accommodates a suitable clamp 30 which opposes separation of the bare ends of conductors in the cable 24 from the corresponding terminals of the switch 26. The handle 23 has a window for the shield 27 which has a limited freedom of reciprocatory movement relative to the handle. The marginal portions of the shield 27 cooperate with suitable guide rails or tracks (not shown) of the handle 23 to hold the shield against stray movements but to enable the operator to exert a pull or push upon the projection 29 in order to open or close the switch 26 for the motor 18**.

The handle 23 further contains the major portion of a rotary regulator 28 which can be turned by one finger of the hand holding the handle in order to intensify or weaken the heating action upon the flow of air in the housing sections 11, 12 and/or to otherwise regulate the operation of the hair dryer 10.

Experiments which were carried out with the improved hair dryer 10 indicate that, when a thyristor 41 is placed into the diffuser 20 in such position that it takes the place of one of the vanes in a standard diffuser (such as the place of one of twelve equidistant vanes in a conventional diffuser), the thyristor is cooled much more reliably and more thoroughly than in heretofore known hair dryers. This is due to the fact that the entire thyristor is located in the flow of relatively cool atmospheric air which is about to reach the heater 16. Moreover, it is not even necessary to depart from the shape of a conventional diffuser since the thyristor 41 can simply take the place of one of the guide vanes in an otherwise conventional diffuser or guide wheel. This, in turn, renders it possible to employ presently known and available hair dryer parts, such as the housing including the sections 11 and 12, because the dimensions of these sections need not be altered in any way.

The illustrated hair dryer 10 can be modified in a number of ways without departing from the spirit of the invention. For example, the shape and/or the dimensions of the recess 37 for the thyristor 41 can be altered, depending upon the shape and/or number of those components which must be cooled by air flowing through the diffuser 20. The extension 42 can support several thyristors, one or more diodes, or one or more diodes and one or more thyristors. The shape and/or size of the notch 40 can also depart from the shape and size shown in FIGS. 4 and 5. Furthermore, the inclination of the guide vanes 36 can be changed so that it departs from the inclination of the surface 40*a* in the notch 40; alternatively, the inclination of the surface 40*a* can be altered if the inclination of the vanes 36 is changed so that the angle $\beta$ again equals or approximates the angle $90°-\alpha$. Still further, the thyristor and/or another component which necessitates cooling in actual use of the appliance can be installed in another part of the diffuser 20 or close to the diffuser, as long as it is properly cooled by atmospheric air flowing toward the heater 16. All that counts is to ensure that the component (be it a diode, a thyristor or any other part which requires cooling) be properly located in a portion of the housing wherein the component is reliably cooled whenever the impeller 22 is driven to induce a flow of atmospheric air into and beyond the diffuser 20.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electric appliance, such as a portable hair dryer, comprising a hollow housing having an air-admitting inlet and an air-discharging outlet; an electric motor disposed in said housing and having at least one component which is heated when connected with a source of electrical energy; impeller means connected with said motor and arranged to induce the flow of air through said housing from said inlet to said outlet; diffuser means provided in the housing in the path of air flow from said inlet to said outlet; and electric air heating means provided in said housing between said diffuser means and said outlet, said at least one component being disposed in said housing in the path of air flowing through said diffuser toward said heating means.

2. The appliance of claim 1, wherein said at least one component is a thyristor.

3. The appliance of claim 1, wherein said at least one component is a diode.

4. The appliance of claim 1, wherein said at least one component is an electronic component.

5. An electric appliance, such as a portable hair dryer, comprising a hollow housing having an air-admitting inlet and an air-discharging outlet; an electric motor disposed in said housing and having at least one component which is heated when connected with a source of electrical energy; impeller means connected with said motor and arranged to induce the flow of air through said housing from said inlet to said outlet; and diffuser means provided in the housing in the path of air flow from said inlet to said outlet, said diffuser means including a plurality of guide vanes and said at least one component being disposed in said diffuser means between two of said vanes.

6. The appliance of claim 5, wherein said guide vanes form an annulus with spaces between neighboring guide vanes of said annulus, said spaces including a relatively wide space for said at least one component and narrower additional spaces of equal width in the circumferential direction of said annulus.

7. The appliance of claim 6, wherein the width of said relatively wide space in the circumferential direction of said annulus equals or approximates the combined width of two additional spaces plus the thickness of a guide vane.

8. The appliance of claim 5, wherein said diffuser means has a recess between said two guide vanes and said at least one component is disposed in said recess.

9. The appliance of claim 8, wherein said motor includes a circuit board having an extension in said recess, said at least one component being provided on said extension.

10. The appliance of claim 9, wherein said diffuser means has surfaces surrounding said recess, said surfaces including two substantially parallel surfaces and a third surface disposed between said parallel surfaces and having a notch for a portion of said extension.

11. The appliance of claim 10, wherein said extension has a free end constituting said portion in said notch.

12. The appliance of claim 10, wherein said impeller means has an additional surface bounding a portion of said notch and making with said parallel surfaces a first angle, each of said guide vanes being inclined with reference to a plane which is normal to the axis of said impeller means at a second angle which equals or approximates 90° minus said first angle.

13. The appliance of claim 12, wherein each of said guide vanes has an arcuate shape.

* * * * *